United States Patent [19]

Schneidinger

[11] 3,985,982

[45] Oct. 12, 1976

[54] LIGHT SWITCH ACTUATING DEVICE

[76] Inventor: Carl Schneidinger, 4 Sorell Lane, Rolling Hills Estates, Calif. 90274

[22] Filed: June 15, 1973

[21] Appl. No.: 370,401

Related U.S. Application Data

[63] Continuation-in-part of Ser. No. 188,235, Oct. 12, 1971, Pat. No. 3,740,680.

[52] U.S. Cl. ..... 200/33 R; 200/38 A

[51] Int. Cl.[2] ..... H01H 43/00

[58] Field of Search ..... 200/33 R, 33 B, 38 A, 200/38 FA, 38 FB, 38 F, 3

[56] References Cited

UNITED STATES PATENTS

| | | | |
|---|---|---|---|
| 2,171,267 | 8/1939 | Doty | 335/168 |
| 2,937,247 | 5/1960 | Laviana et al. | 200/33 B X |
| 3,179,758 | 4/1965 | Trock | 200/33 R X |

*Primary Examiner*—Robert K. Schaefer
*Assistant Examiner*—John J. Feldhaus
*Attorney, Agent, or Firm*—Herbert C. Schulze

[57] ABSTRACT

This is an actuating device to be attached to a wall-mounted switch plate for actuating a light switch in a room or other place at a pre-determined time interval and/or for deactivating such light switch or a combination of the two. The device is particularly characterized and it may mount onto the wall place and does not require disconnection thereof from the wall or alternatively may replace the wall plate. It is further characterized by a simple, manual, override switch.

3 Claims, 7 Drawing Figures

LIGHT SWITCH ACTUATING DEVICE

CROSS REFERENCE TO RELATED PATENT APPLICATIONS

This application is related to, and is a continuation in part of, my co-pending application, Ser. No. 188,235, filed Oct. 12, 1971, now U.S. Pat. No. 3,740,680, June 19, 1973.

BACKGROUND OF THE INVENTION

1. Field of the Invention

This invention lies within the general field of electrical lighting switches and more particularly in the field of a device to actuate electrical light switches at a predetermined time interval and is particularly further characterized in falling within the field of an attachment to existing light switches in existing buildings.

2. Description of the Prior Art

For many years, timing devices have been made to actuate electrical currents for such purposes as turning lights on and off, for actuating radios and other utensils, and the like. All of such inventions are characterized by the necessity of an independent connection such as an independent time actuating device into which a light or the utensil is connected, or a separate timing device connected into a circuit which is the sole means of actuating the light or other device being activated. The present invention includes a device to cooperate with and, in combination with, to activate a customary wall switch upon the wall in existing buildings and the like. The prior art includes my aforereferenced application, Ser. No. 188,235, filed Oct. 12, 1971, now U.S. Pat. No. 3,740,680, June 19, 1973, U.S. Pat. Nos. 2,171,267; 3,179,396; 2,937,247; and 3,179,396.

There is other art in the field of automatic switching and time delay switching, and the like, but not related to the specific application in combination with wall switches.

SUMMARY OF THE INVENTION

There is a constantly increasing demand, desire, and requirement, for protective devices and for security in all fields, as well as for convenience.

In the past, there have been devices designed to turn on lights of one sort or another about buildings at various times of day or to be actuated by approching darkness and to be deactivated by approaching light of day.

There are also timing devices which can be used and in which, for example, a lamp may be inserted for such purposes.

In the customary home, however, most customarily used lights are activated by a switch mounted upon, or within, a wall, or the like. There has not, so far, been a device developed to activate those customarily used lights and thus one who is intent upon intrusion may recognize the artificiality of protective lights being lighted at various times.

Up until now, it has been impractical to activate a light or all lights which are toggle switch actuated by an automatic timing or light-sensitive device.

I have approached this problem in a manner by which I am able to provide a device which is easily and safely installed by a homeowner without large expense, and which can activate individual, normally used lights within a home by a cooperative arrangement such customary switches as are found in most homes. I have accomplished this by combining a timing device and a switch-actuating device controlled by the timing device together with a power supply and which is so designed and constructed as to cooperate with an existing switch plate (which are virtually standard throughout the United States).

It has been my purpose, therefore, to provide a device which will not interfere with the normal switch operation, but will cooperate with the same and yet have an override for either a manual or automatic operation. Further, it has been a purpose that I provide a device which a housewife, or other person unskilled in the electrical arts, may utilize with no special electrical hook-up required and which will be perfectly safe in ordinary installation by unskilled persons.

It is an object of this invention to provide a timing device to actuate customary electric wall switch;

It is a further object of this invention to provide a means for intermittently actuating and deactuating an electric wall switch;

It is a further object of this invention to provide a device as heretofore described which cooperates with the existing wall switch;

It is another object of this invention to provide a device as described which can be actuated by changing conditions of light, or the like;

It is a further object of this invention to provide a device as described, which can be installed without electrical connection by one unskilled in the electrical arts.

The foregoing and other objects and advantages of this invention will be clear to those skilled in the art upon reading the Description of a Preferred Embodiment in conjunction with the appended drawings.

DESCRIPTION OF A PREFERRED EMBODIMENT

It will be clear that a basic light switch and face plate 10 comprises the switch toggle 18, the face plate 12 with the toggle protruding through an appropriate opening therein, and screws 14 and 16, which hold the face plate to the switch box in the wall, which is well-known in art.

Figure 1:
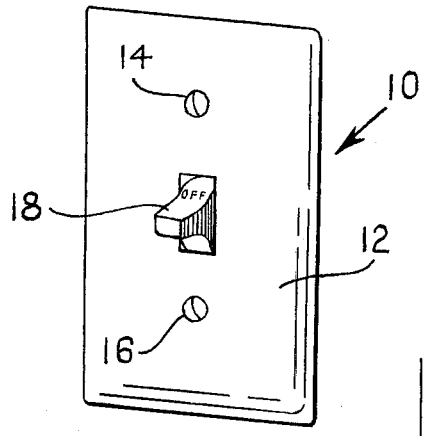
FIG. 1 is a perspective of a customary electric light wall switch.
Figure 2:
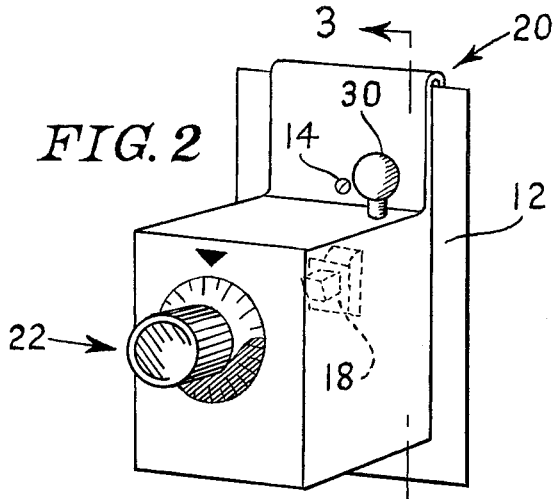
FIG. 2 is a perspective of the same device of FIG. 1 with the invention of this application shown in place and the switch-actuating lever itself shown in phantom.
Figure 3:
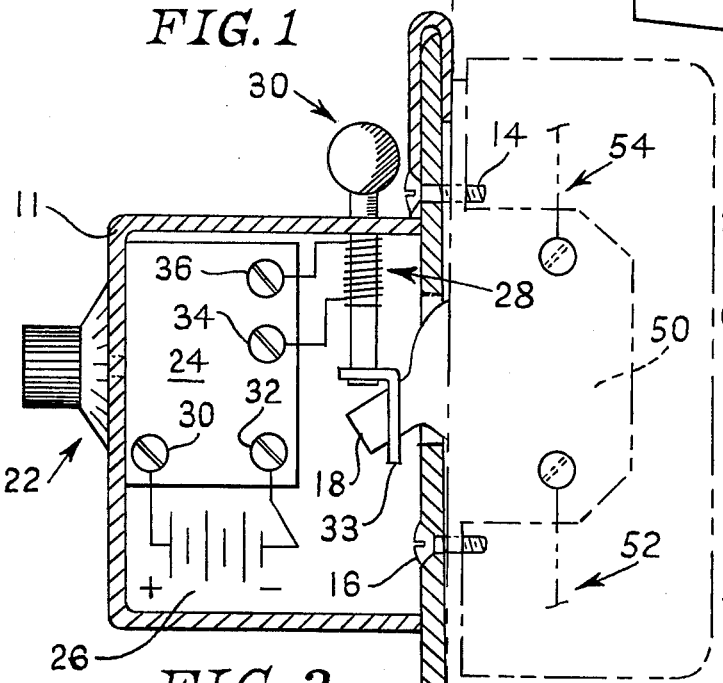
FIG. 3 is an enlarged sectional view through 3-3 of FIG. 2.

In FIG. 2, there is seen the face plate 12 covered by the device of this invention, and in which an intregal part of the case is a generally U-shaped hanger with an appropriate hole to accommodate screw 14 as is best illustrated in FIG. 3.

The case 11 may be formed of plastic, metal or any other suitable material and contains therein the power unit 26 which may be a battery or the like, suitable to actuate the timing device and solenoid hereinafter described.

The timing device 24 is of a customary electronic timing device such as a capacitor-type timer which is well-known in the art. There are many electrical timers and any would be suitable.

Likewise, the timer 24 may be a spring-actuated timer such as, for example, the type of timer used in photographic work or an ordinary clock work timer such as an alarm clock type mechanism.

The two leads from the battery or power source are connected into the time at 30 and 32 and two leads out of the timer at 34 and 36 take power to solenoid 28. The solenoid 28 is preferably a "push-pull" type solenoid or lineal actuator so that it may actuate both to turn on the switch or to turn it off. An override knob 30 is provided and a bracket 33 which can be a U-shaped offset attachment to the end of the solenoid core as roughly shown, and, as is well-understood in the art, completes the mechanical arrangement to the switch.

In phantom on FIG. 3 are shown the two electrical leads 52 and 54, the switch itself 50 and the customary swich mounting box 60.

As previously indicated, all of the elements shown may be replaced by spring-actuated, lever-actuated, or other similar mechanical devices all of which are well-known in the art and all of which are well-known and well-developed for the art of timing.

In the particular illustrations, the control dial 22 (and in FIG. 4, 122) is a simple representation of a control dial such as is customarily used with such devices to set a time for the actuation of the unit. As is wellknown in the art, there may be two control dials, one setting a time for actuation and one setting a time for a reverse actuation. Likewise, the timer itself may be so constructed as to be only actuated once and in its own mechanism (not shown) to reverse its actuation after a given elapsed time. Likewise, there may be two or more control dials or settings for control of the timing device. Some timers become very complex and such timer can be used within this device, whether or not they are electrically operated, spring operated, or actuated in some other manner.

It will also be understood that the device can be operated by manually making an initial setting by utilization of the knob 30, and then allowing all further settings or changes of position of the switch toggle 18 to take place by the use of the timer.

Although not commented upon at great length, the override knob 30 is of importance in that is is frequently desirable to override, or cancel, the action of the automatic timing device because of changed or unusual circumstances. Many times timers are so constructed, that their entire timing cycle must be altered by use of the control knob, or otherwise, in order to override the single cycle concerned. In the case of my device, I make it possible, by the simple addition of the override knob to override any given cycle without changing the basic configuration.

Also, although only commented upon briefly, the cooperative arrangement of the entire unit, with a wall plate, requiring the removal of only one mounting screw on the face plate is of importance. In this manner, an individual who is not technically qualified to work upon a light switch in safety, may install the device on one or more electrical switches already in an older building. He may also move such device from one switch to another as desired to create a changing effect within the house and yet with a simple, "non-professional" approach.

Figure 4:
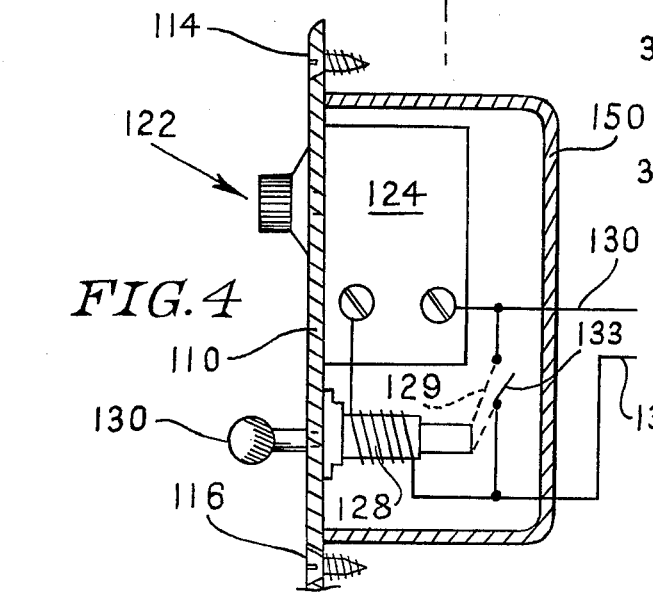
FIG. 4 is an alternate embodiment of the device of this invention in partial section and partial schematic.

FIG. 4 illustrates an alternate arrangement in which the customary wall box switch is replaced by a new switch which mounts within the wall cavity, said switch being generally 150, comprising a case, as shown in partial section together with an appropriate timing device 124, solenoid 128, override knob 130, face plate 110, and electrical leads 130 and 132, together with switch 133. The switch 133 may be actuated by the solenoid 128 and this connection is shown by phantom lines 129. The switch will go to the light or the like being actually activated, and the current in the regular line will activate and actuate the timing mechanism 124. While the device of FIG. 4 is of importance in those instances where it may be desired to mount the entire device within the wall, it is of somewhat less interest to a homeowner or other individual who may wish to do the work without requiring a professional electrician. FIG. 4 shows a basic schematic arrangement, lacking in detail, since the details are well-known in the art. In this case, arrangements are made for the electrical current available at 130 and 132 to be utilized to activate the timer. The electrical current, it will be noted, also is used as activation for the solenoid when the line 130 is closed within the timer.

The switch 133 is simply used to control the light, or other device operated by electricity. In this case, one portion of the electrical energy required for the light, or other device, is directed through the switch when it is closed (details not shown) as will be understood. It is likewise clear that the same effect may be achieved within a wall-mounted unit, by substituting a mechanical timer 124 and/or mechanical actuator for 128. In these cases, once again, a control knob 130 is utilized by direct connection to the actuating device in order to provide for manual override without effecting any permanent settings which may have been made in the device.

Figure 5:
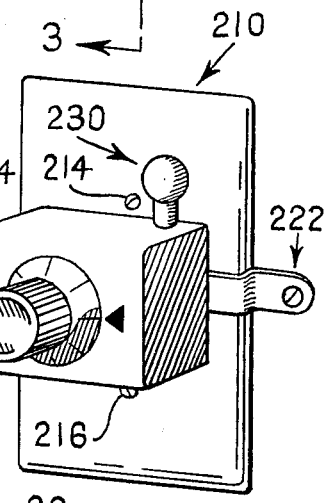
FIG. 5 is a perspective of an alternate embodiment of the device of this invention.

FIG. 5 illustrates in perspective an alternate embodiment of the device in which the device has been so constructed as to have two tabs 222 and 224 connected to the housing 220 of the device in such manner that screws or the like may be used to fasten the device to the sides of the wall, or in other convenient manner, without interfering with the switch plate at all, not even the removal of the one screw.

It will be clear that the mechanism within the housing 220 will be essentially the same as the mechanism within the other housings shown and described.

Figure 6:
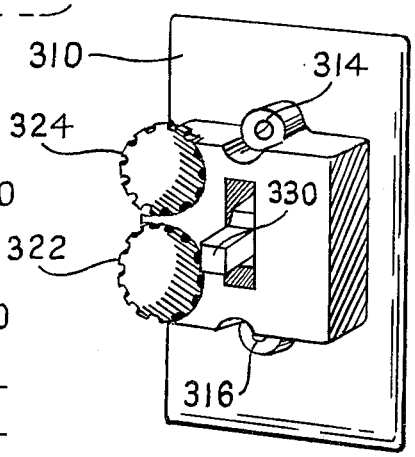
FIG. 6 is a perspective of another alternate embodiment.

FIG. 6 illustrates a switch plate which becomes an alternate embodiment of this device in which the switch plate 310 has formed as an intregal part thereof timing device generally 320 and two standard-spaced holes for screws 314 and 316.

Within the device 320, the mechanism will be generally the same as shown although the override mechanism may preferably be a switch 330 protruding from the front of the case 320. The standard switch lever 318 will be engaged substantially as heretofore described and shown in the other embodiments.

In this instance, the entire existing face plate would be removed and the new face plate 310 carrying the entire mechanism would merely be replaced and would serve the purpose of making a neater and simpler installation.

The mechanism may be the same as any of those heretofore described.

As heretofore mentioned, any of the mechanisms may have two setting dials, for example, 322 and 324, or one as shown in the other examples, or no settings dials, having the entire setting arranged internally.

It should be clear, also, to those skilled in the art that the setting dial 22 and 122; 322 and 324, all as shown in the drawings, may be eliminated completely and all of the settings may take place within the device, if desired.

It will further be clear that a simple knob as shown at 30 and 130, attached to the actuating device for purposes of override may be in the form of a toggle switch, or the like, which is well-known in the art. In this case, appropriate louvers and connections will be provided so that the manual actuation of the switch toggle is easily accomplished.

Figure 7:
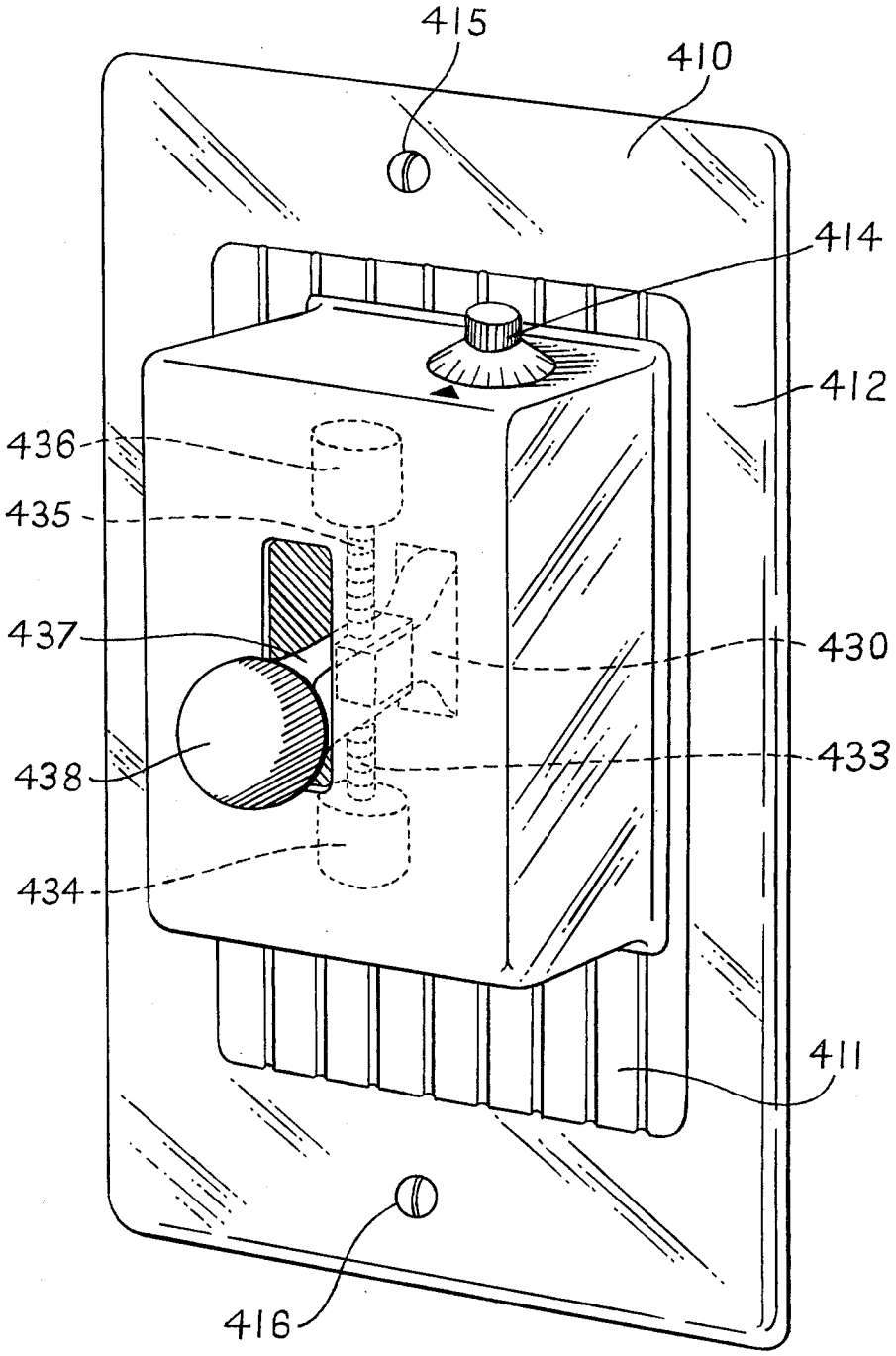
FIG. 7 is a perspective with certain elements indicated in schematic phantom of another alternate embodiment of this invention.

FIG. 7 shows a most interesting variation of this invention in which there is a wall plate 410 fastened with the standard screws 415 and 416 into the standard screw hole connections in a standard wall switch box.

In the particular depiction shown, a patterned embodiment 411 is indicated over a portion of the wall plate for decorative effects. A box, 412, is molded or glued onto the decorative portion 411, which box contains a mechanism comprising a timing device (not shown), preferably spring-wound, consisting of springs 436 and 434, appropriately connected to the timing winder 414 by gear train, or the like, customary in the art and not shown, since it will be understood. Each of these spring-wound devices is further connected to and actuates a spring-loaded mechanism 433 or 435 which upon release will cause the switch handle 437, which carries an actuating override knob 438 to move upward or downward. The switch handle 437 will be seen to connect over the customary switch lever 430 by a socket-like arrangement, so that no special tools, skills or alteration is required during installation, but merely that it slip over the handle.

In operation, the standard wall plate is removed and the wall plate 410 carrying the actuating device is put in its place with the socket in item 437 engaging the switch toggle 430 as indicated. The standard screws 415 and 416 are used to fasten the switch plate carrying the timer in place.

The switch is now placed either in the "On" or "Off" position by utilization of the knob 438. The time desired is set upon, and by, the turning of the knob 414 which appropriately winds the spring timing mechanism 436 or 434 as the case may be. Upon the release of the expired time by unit 434 or 436, the spring-loaded actuating arm 433 or 435 respectively is activated so as to cause the switch to be moved from the "On" position to the "Off" position or vice versa.

Throughout, no details of construction of timers, and the like, have been shown since these are well-known to those skilled in the art. Likewise, the mechanical connections and the solenoid have been shown schematically for simplicity, since mechanical details will be a matter of choice.

While the devices illustrated and described herein are fully capable of achieving the objects and advantages desired, it will be clear that many modifications may be made without departing from the inventive concepts disclosed. For example, the timing device itself may be actuated by a photo-electric cell or other light-sensitive device or even by proximity devices, and the like.

The particular descriptions are for illustrative purposes only and not for purposes of limitation.

I claim:

1. A wall mounted, electrical actuating device comprising:

1. A carrying plate suitable to mount upon the wall of a building; a housing carried by said carrying plate on the side opposite the wall upon which the plate will be mounted; a control knob divided in gradations of time mounted upon said case and connected through the wall of said case to a timing mechanism on the interior of said case; said control knob connected through said case to a mechanism including two timing devices and by which the said timing devices will simultaneously be set; each of said timing devices being connected to an actuating mechanism; an override control knob which extends through an opening in said case from the outside thereof to the inside thereof; each of said actuating mechanisms being in opposed relation to the other actuating mechanism and connected to opposed sides of an extension on said override control knob; and means cooperative with said knob to engage an electrical switch actuating lever upon a wall to which the said plate will be attached.

2. The device of claim 1 in which the extension on said override control knob is so adapted as to engage one or the other of said two timing devices depending upon which is in the engaged position with reference to the position of the override control knob.

3. The device of claim 2 in which said override control knob actuates the opposed timing devices alternately depending upon the starting position of the said override control knob at the time said control knob is actuated.

* * * * *